US008651622B2

(12) United States Patent
Oikawa et al.

(10) Patent No.: US 8,651,622 B2
(45) Date of Patent: Feb. 18, 2014

(54) RECORDING APPARATUS

(75) Inventors: Satoshi Oikawa, Yokohama (JP); Yusuke Kiyokawa, Shiki (JP); Kenji Kitabatake, Kawasaki (JP); Takuya Iwano, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 13/235,997

(22) Filed: Sep. 19, 2011

(65) Prior Publication Data

US 2012/0120154 A1 May 17, 2012

(30) Foreign Application Priority Data

Nov. 17, 2010 (JP) ..... 2010-256942

(51) Int. Cl.
*B41J 2/14* (2006.01)
*B41J 29/393* (2006.01)

(52) U.S. Cl.
USPC ..... 347/47; 347/19

(58) Field of Classification Search
USPC ..... 347/7, 19, 56–57, 87
See application file for complete search history.

(56) References Cited

U.S. PATENT DOCUMENTS 6,010,201 A * 1/2000 Shimoda ..... 347/7
7,150,519 B2 * 12/2006 Kono et al. ..... 347/85
7,909,444 B2 * 3/2011 Oomura ..... 347/7
8,226,187 B2 * 7/2012 Snyder et al. ..... 347/7
2001/0038396 A1 * 11/2001 Imanaka et al. ..... 347/7

FOREIGN PATENT DOCUMENTS

JP 08-39829 A 2/1996
JP 10034971 A * 2/1998

OTHER PUBLICATIONS

Definition of Hole, Free Merriam-Webster's Online Dictionary, p. 2, Jun. 24, 2013.*
Definition of Through, Free Merriam-Webster's Online Dictionary, pp. 2-3, Jun. 24, 2013.*

* cited by examiner

*Primary Examiner* — Lisa M Solomon
(74) *Attorney, Agent, or Firm* — Fitzpatrick, Cella, Harper & Scinto

(57) ABSTRACT

A liquid ejection apparatus has an ejection orifice ejecting a liquid, a liquid storage section storing the liquid, a conductive communication path forming member forming a communication path to supply the liquid from the liquid storage section to the ejection orifice, and an electrode provided inside the liquid storage section and used to detect a remaining amount of the liquid. The communication path is electrically connected to the electrode, and the electrical resistance value between the electrode and the communication path contacting the liquid when the liquid is present in the liquid storage section is smaller than the electrical resistance value between the electrode and the communication path when the liquid is not present in the liquid storage section. A recording apparatus incorporating the above features can detect the presence or absence of ink in the recording head with high precision without increasing the size of the recording head.

6 Claims, 2 Drawing Sheets

RECORDING APPARATUS

BACKGROUND OF THE INVENTION

1. Field of the Invention

The present invention relates to a recording apparatus having a recording head.

2. Description of the Related Art

An example of the recording apparatus includes a main tank storing ink, a recording head having a subtank, and an ink supply tube through which the ink is supplied from the main tank to the subtank.

The recording head includes a tank section having the subtank temporarily storing ink supplied from the main tank; and an ejection section having an ejection orifice for ejecting the ink.

In order to determine an appropriate time to supply ink from the main tank to the subtank, the recording head may have a mechanism for detecting the presence or absence of ink in the subtank.

Examples of methods of detecting the presence or absence of ink in the subtank include a method by which two electrodes are arranged each in a different place in the subtank and an inter-electrode electrical resistance value is measured to detect the presence or absence of ink.

If ink is present between the two electrodes, a predetermined inter-electrode electrical resistance value is measured across the electrodes through the ink. Conversely, if no ink is present between the two electrodes, a larger electrical resistance value is detected. Thus, the presence or absence of ink in the subtank is determined by detecting the difference in the electrical resistance value. If the absence of ink is determined, ink is supplied from the main tank to the subtank. The ink continues to be supplied to the subtank until the presence of ink is determined.

Unfortunately, use of two electrodes requires a larger space for installing the two electrodes, and thus involves a larger subtank and hence a larger recording head. In light of this, Japanese Patent Application Laid-Open No. H08-39829 discloses a method of reducing electrode installation space. In general, the ejection section includes therein a common liquid chamber connected to the subtank; and an ejection orifice for ejecting ink from inside the common liquid chamber to outside the recording head. The common liquid chamber includes therein an energy generating element for generating energy for ejecting ink. When the energy generating element directly contacts ink, the energy generating element corrodes. In light of this, the energy generating element is generally covered with a conductive anti-cavitation film or the like. Japanese Patent Application Laid-Open No. H08-39829 discloses a configuration of reducing the number of electrodes installed in the subtank to one by using the anti-cavitation film as one electrode.

SUMMARY OF THE INVENTION

Recent years have seen a reduction in size of the recording head and an increase in density of the ejection orifice, leading to a reduction in size of the energy generating element as well as a great reduction in area of the anti-cavitation film. Accordingly, a sufficient contact area between ink and the anti-cavitation film cannot be secured. A smaller contact area between ink and the anti-cavitation film for use as the electrode greatly increases the electrical resistance value in a contact portion between ink and the anti-cavitation film. Accordingly, even if sufficient ink remains in the subtank, the measured electrical resistance value increases, leading to a difficulty in determining the presence or absence of ink.

In view of the above problem, the present invention is to provide a recording apparatus capable of detecting the presence or absence of ink in the recording head with high precision without increasing the size of the recording head.

The recording apparatus of the present invention is a liquid ejection apparatus comprising: an ejection orifice ejecting a liquid, a liquid storage section storing the liquid, a conductive communication path forming member forming a communication path to supply the liquid from the liquid storage section to the ejection orifice; and an electrode provided inside the liquid storage section and used to detect a remaining amount of the liquid, wherein the electrode is electrically connected to the communication path forming member by contacting the liquid and using the liquid as a medium.

Further features of the present invention will become apparent from the following description of exemplary embodiments with reference to the attached drawings.

DESCRIPTION OF THE EMBODIMENTS

Figure 1A:
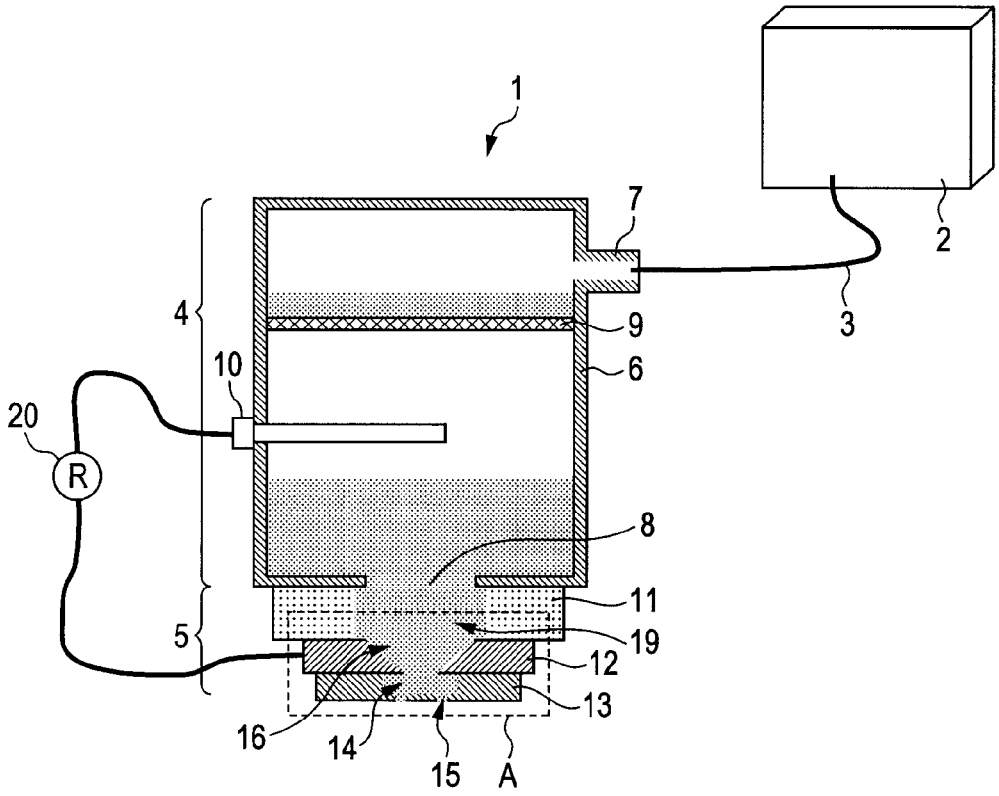
FIGS. 1A and 1B are schematic configuration views of essential parts of a recording apparatus according to an embodiment of the present invention.

Preferred embodiments of the present invention will now be described in detail in accordance with the accompanying drawings.

Now, embodiments of the present invention will be described based on the accompanying drawings. Note that the same reference numerals or characters may be assigned to the components having the same function in the accompanying drawings, and the description thereof may be omitted.

Figure 1B:
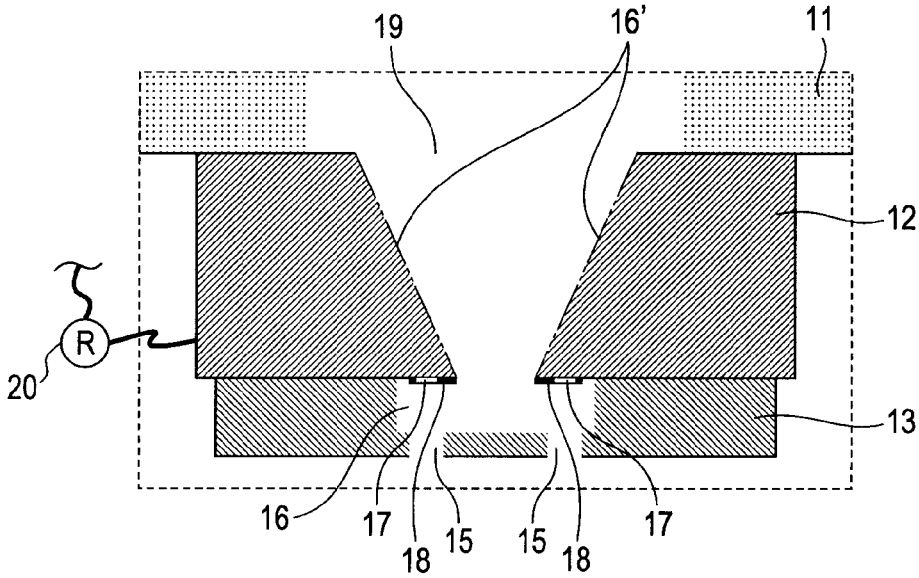

FIGS. 1A and 1B are schematic configuration views of essential parts of a recording head according to an embodiment of the present invention. FIG. 1A is a schematic view of a cross-section of the recording head and FIG. 1B is an enlarged schematic view of a portion indicated by A in FIG. 1A. Note that no ink is illustrated in FIG. 1B.

The recording apparatus of the present invention includes a recording head 1, a main tank 2 storing ink, and an ink supply tube 3 through which ink is supplied from the main tank 2 to the recording head 1.

The recording head 1 includes a tank section 4 and an ejection section 5. The tank section 4 includes a subtank 6 as an ink storage section for storing ink supplied from the main tank 2; an ink supply tube connection section 7 connected to the ink supply tube 3 to pass ink therethrough; and an opening section 8 as an opening communicatively connected to the ejection section 5. Further, the inside of the subtank 6 is divided into two spaces by a dust collection filter 9 for collecting dust in ink supplied from the main tank 2. One space (lower portion) of the divided two spaces includes an electrode 10 (one electrode) inserted thereinto from outside and the opening section 8. The other space (upper portion) includes the ink supply tube connection section 7.

The ejection section 5 includes a base member 11, a conductive ejection substrate 12, and an ejection orifice forming section 13, which are stacked in sequence from the surface having the opening section 8 of the subtank 6. The ejection section 5 further includes a common liquid chamber 14 formed from a surface on the side of the ejection substrate 12 of the ejection orifice forming section 13 toward inside thereof; and a plurality of ejection orifices 15 formed from a surface on an opposite side of the ejection substrate 12 of the ejection orifice forming section 13 toward inside thereof to eject ink. The common liquid chamber 14 is connected to each ejection orifice 15 inside the ejection orifice forming section 13. The ejection substrate 12 has two openings, one on a surface on the side of the base member 11 and one on a surface on the side of the ejection orifice forming section 13. The two openings are connected to each other through the substrate side ink supply section 16. The substrate side ink supply section 16 is connected to the common liquid chamber 14 through an opening on a surface on the side of the ejection orifice forming section 13 of the ejection substrate 12. Further, an energy generating element 17 for generating energy for ejecting ink is covered with an anti-cavitation film 18 and provided on an outer surface of the ejection substrate 12 and around an opening of a surface on the side of ejection orifice forming section 13. Note that the ejection substrate 12 is insulated from the energy generating element 17, and the anti-cavitation film 18 is made of a material difficult to conduct. The base member 11 has a base side ink supply section 19 communicatively connected from the opening section 8 of the subtank 6 to the ink supply section 16 of the ejection substrate 12.

The main tank 2 has an unillustrated ink supply mechanism such as a pump and is configured to supply ink to the subtank 6. The ink supplied from the main tank 2 flows in the order of the ink supply tube 3, the ink supply tube connection section 7 of the tank section 4, an upper portion of the subtank 6, the dust collection filter 9, and a lower portion of the subtank 6. Further, the ink is supplied from the lower portion of the subtank 6 to the ejection section 5, from which the ink flows in the order of the base side ink supply section 19, the substrate side ink supply section 16, and the common liquid chamber 14. The ink in the common liquid chamber 14 is energized by the energy generating element 17 to be ejected from the ejection orifice 15 to outside the recording head 1.

As an example of materials for respective members, the subtank 6 and the ejection orifice forming section 13 are made of resin, the base member 11 is made of ceramic, and the ejection substrate 12 is made of conductive silicon.

Now, a configuration for detecting the presence or absence of ink in the subtank 6 will be described. The electrode 10 is inserted into the subtank 6 from outside thereof, more specifically, into a lower portion of the subtank 6, namely, a position closer to the side of the base member 11 than the dust collection filter 9. An electrical resistance measurement circuit 20 is provided outside the recording head 1. One end of the electrical resistance measurement circuit 20 is connected to the electrode 10 (one electrode) and the other end thereof is electrically connected to the conductive ejection substrate 12 (the other electrode). The electrical resistance measurement circuit 20 is used to measure an electrical resistance value between the electrode 10 and the ejection substrate 12. Note that the electrode 10 is made of, for example, stainless steel.

A wall surface 16' (indicated by a two-dot chain line in FIG. 1B) forming a substrate side ink supply section 16 of the ejection substrate 12 is an ink contact surface contacting ink to function as the other electrode for detecting the presence or absence of ink.

Figure 2:
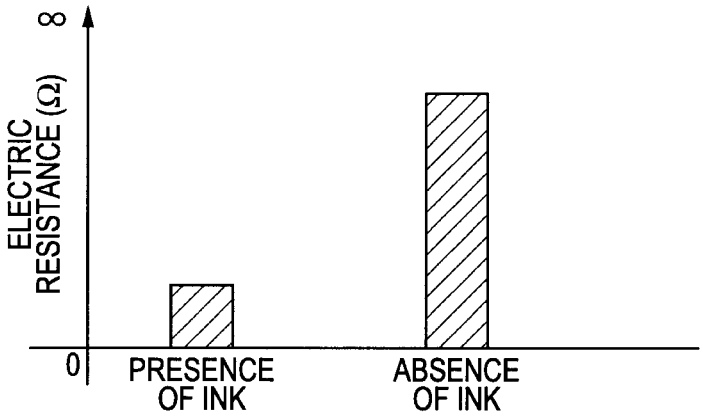
FIG. 2 is a graph illustrating an example of measurement results of electrical resistance values.

In general, ink for use in the recording apparatus includes water, various solvents, dyes or pigments and thus has conductivity. Accordingly, when the liquid surface of the ink in the subtank 6 is located above the electrode 10, namely, on the side of the dust collection filter 9, the electrical resistance value detected by the electrical resistance measurement circuit 20 is a specific electrical resistance value per unit length depending on the physical property (electrical conductivity) of the ink used (see the presence of ink in FIG. 2). Accordingly, the electrical resistance value increases with an increase in length of ink interposed between the two electrodes. Thus, detection of the electrical resistance value allows a multistage ink level detection.

A recording operation or a cleaning operation of the ejection orifice 15 and the like lowers the ink level in the subtank 6 and the ink liquid surface is lower than the electrode 10, namely, on the side of the base member 11. At this time, the electrical resistance value detected by the electrical resistance measurement circuit 20 is a remarkably large electrical resistance value because gas (air) with a very high electrical resistance value exists between the electrode 10 and the ejection substrate 12 (see the absence of ink in FIG. 2).

The recording apparatus has an unillustrated supply determination circuit for determining whether it is required to supply ink from the main tank 2 to the subtank 6. Based on the signal sent according to the determination results, the ink supply mechanism supplies ink from the main tank 2 to the subtank 6.

A comparison is made on the difference between a measured electrical resistance value and a preset ink-specific electrical resistance value to determine the presence or absence of ink and the need to supply ink. If needed, the ink supply mechanism starts to supply ink.

As described above, in recent years, with the reduction in size of the recording head and the increase in density of the ejection orifice, the size of the anti-cavitation film also reduces. Accordingly, the conventional recording head using the anti-cavitation film as the electrode has a smaller contact area between the ink and the anti-cavitation film, leading to a larger electrical resistance value in a contact portion between the ink and the anti-cavitation film. As a result, even if sufficient ink remains, a large electrical resistance value may be measured, leading to a difficulty to determine the presence or absence of ink. In contrast to this, the present invention uses the ejection substrate 12 as the other electrode for detecting the presence or absence of ink to allow ink to contact the entire region of the wall surface 16' forming the substrate side ink supply opening 16, thereby increasing the contact area between the ink and the wall surface 16'. Thus, the electrical resistance value can be measured with high precision. As a result, ink can be supplied from the main tank 2 to the subtank 6 at an optimum timing so as to reduce recording wait time for ink supply.

Figure 3:
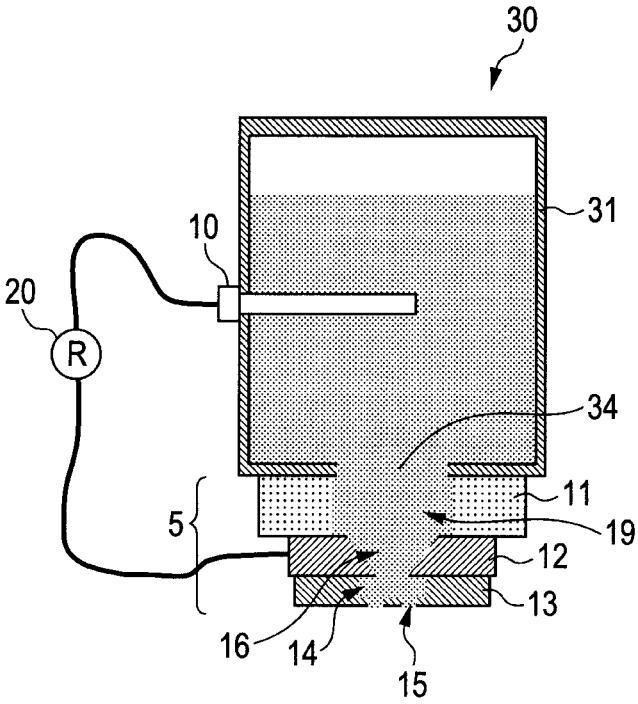
FIG. 3 is a schematic configuration view of essential parts of a recording head according to another embodiment of the present invention.

FIG. 3 is a schematic configuration view of essential parts of a recording head according to another embodiment of the present invention. Note that the description of the same components as described in the above embodiment will be omitted.

The present embodiment provides a recording head 30 integrally formed with an ink tank 31 as an ink storage section storing all ink, which is different from providing the main tank outside the recording head to supply ink to the recording head. The present embodiment needs to replace the recording head 30 when the ink stored in the ink tank 31 is exhausted. Note that although not illustrated, an unillustrated recording apparatus includes an inter-electrode electrical resistance value measurement circuit and a replacement determination circuit for determining the need to replace the recording head 30 based on the measurement results. Further, the unillustrated recording apparatus includes a replacement notification circuit for notifying a display section of the unillustrated recording apparatus of replacement of the recording head 30 based on the determination results of the replacement determination circuit.

The recording head 30 includes an ink tank 31 and an ejection section 5 similar to the one described in the above embodiment. Like the above embodiment, the ink tank 31 includes an electrode 10 (one electrode) and an opening section 34. The ejection section 5 and the other electrode have the same configuration as described in the above embodiment. More specifically, the opening section 34 of the ink tank 31 is communicatively connected to the ejection orifice 15 of the ejection orifice forming section 13.

The method and principle of detecting the presence or absence of ink are the same described in the above embodiment. The presence or absence of ink in the ink tank 31 is determined in the same manner as described in the above embodiment. If a determination is made that no ink is present, the user is notified of the replacement of the recording head by displaying a message to that effect on an unillustrated display screen of the recording apparatus. In practice, it is more preferable to prompt the user to prepare for a replacement recording head by notifying the user of ink shortage before the ink is completely exhausted. Then, the user has enough time to cope with this situation (specifically replace the recording head) before the ink is completely exhausted and recording is disabled. However, too early notification that ink in the ink tank 31 is exhausted may result in replacing the recording head 30 though sufficient ink remains in the ink tank 31, wasting the ink remaining in the ink tank 31. The recording head 30 of the present invention can measure the change in inter-electrode electrical resistance with high precision and thus allows the recording head 30 to be replaced at an optimum timing.

As described hereinbefore, the recording head of the present invention can reduce the recording wait time to reduce the burden on the user. Further, the recording head can be replaced with a new recording head so as to minimize the remaining amount of ink as much as possible.

In addition, the recording apparatus mounting the recording head 1 of the present invention is also expected to improve ease of use for the user. Specifically, any recording apparatus including an electrical resistance measurement circuit for measuring the inter-electrode electrical resistance value of the recording head 1 and an unillustrated supply determination circuit for determining the need to supply ink from the main tank 2 to the subtank 6 can supply ink at an optimum timing. The recording head integrally formed with the ink tank allows the recording head to be replaced at an optimum timing. In addition, an increase in size of the recording head can be prevented and thus an increase in size of the recording apparatus can be suppressed. Thus, the present invention can provide a space-saving recording apparatus reducing adverse effects such as noise due to an ink supply operation and a recording wait time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-256942, filed Nov. 17, 2010, which is hereby incorporated by reference herein in its entirety.

What is claimed is:

1. A liquid ejection apparatus comprising:

an ejection orifice ejecting a liquid;

a liquid storage section storing the liquid;

a conductive communication path forming substrate, which includes an energy generating element for generating energy for ejecting the liquid, forming a communication path by a through-hole that penetrates the conductive communication path forming substrate to supply the liquid from the liquid storage section to the ejection orifice; and an electrode provided inside the liquid storage section and used to detect a remaining amount of the liquid, wherein the electrode is electrically connected to a surface of the communication path by contacting the liquid and using the liquid as a conductive medium.

2. The liquid ejection apparatus according to claim 1, wherein the liquid is ink.

3. The liquid ejection apparatus according to claim 1, wherein the liquid is determined to be not present in the liquid storage section if the electrode does not contact the liquid.

4. The liquid ejection apparatus according to claim 1, wherein the electrode is further electrically connected to the communication path forming substrate through an electrical resistance measurement circuit.

5. The liquid ejection apparatus according to claim 1, wherein the communication path forming substrate is a silicon substrate on which the energy generating element is provided.

6. The liquid ejection apparatus according to claim 1, wherein the liquid storage section has a tube connection section connected to a tube for supplying the liquid from outside the liquid ejection apparatus, and a filter for dividing the liquid storage section into a space containing the tube connection section and a space containing the electrode.

* * * * *